United States Patent [19]

Whitted et al.

[11] 4,064,686

[45] Dec. 27, 1977

[54] INTERMITTENTLY BULKED YARN

[76] Inventors: Robert L. Whitted, Rte. 7, N. Parker Road, Greenville, S.C. 29609; James E. Simmons, Rte. 1, Marietta, S.C. 29661

[21] Appl. No.: 655,671

[22] Filed: Feb. 9, 1976

Related U.S. Application Data

[63] Continuation-in-part of Ser. No. 553,838, Feb. 2, 1975, abandoned.

[51] Int. Cl.[2] ..... D02G 3/24; D02G 3/34; D02G 1/16

[52] U.S. Cl. ..... 57/140 J; 28/276; 57/157 F

[58] Field of Search ..... 57/34 B, 140 J, 144, 57/157 F, 157 R, 160, 140 BY, 139; 28/1.4, 72.12, 274–276

[56] References Cited

U.S. PATENT DOCUMENTS

| | | | |
|---|---|---|---|
| 3,389,444 | 6/1968 | Fletcher et al. | 57/34 B X |
| 3,417,445 | 12/1968 | Gemeinhardt et al. | 28/1.4 |
| 3,477,220 | 11/1969 | Marshall | 57/140 J |
| 3,568,426 | 3/1971 | Whitley | 57/140 J |
| 3,823,541 | 7/1974 | Buzano | 57/144 |
| 3,846,968 | 11/1974 | Sheehan et al. | 57/140 J |

*Primary Examiner*—John Petrakes
*Attorney, Agent, or Firm*—Bailey, Dority & Flint

[57] ABSTRACT

A bulk yarn formed from a plurality of multi-filament yarns having alternating compact and open segments. The compact segments include first and second plaited portions which are twisted in opposite directions. The open segments of the yarn are defined by loosely bundled multi-filament yarn. The apparatus for bulking the yarn includes an elongated housing having a longitudinal bore extending therethrough. Pressurized air passes through diametrically opposed passages for contacting the yarn as it passes through the bore for producing the bulking effect thereon.

3 Claims, 7 Drawing Figures

INTERMITTENTLY BULKED YARN

This is a continuation-in-part application of application Ser. No. 553,838, entitled METHOD AND APPARATUS FOR BULKING YARN filed on Feb. 2, 1975 now abandoned.

BACKGROUND OF THE INVENTION

The present invention relates to bulk yarn and the method and apparatus for manufacturing bulk yarn, and more particularly to an apparatus which utilizes opposed jets of air for bulking strands of multi-filament yarn.

Heretofore, yarns have been curled or bulked by the use of mechanical apparatus which engages the yarn for bulking the yarn. It has also been known that jets of gas, such as air, may be utilized for imparting a bulking or curled effect to the yarn. These bulk yarns may be woven into fabrics and used for many different applications, such as in drapes.

One example of a device for bulking yarn is disclosed in U.S. Pat. No. 3,823,541, granted to M. Buzano on July 16, 1964. This device discloses an apparatus for bulking yarn wherein a jet of air engages yarn passing through a passage for imparting bulk sections within the yarn. As disclosed in column 3 of the patent the process generally involves yarn speeds greater than 100 meters per minute preferably greater than 200 meters per minute.

U.S. Pat. No. 3,807,862 granted to E. J. Griset, Jr. on Oct. 1, 1957 discloses still another method of bulking yarn. In this particular apparatus, the yarn is fed past a stream of air at an angle. Such, in turn, causes the yarn to be curled or bulked.

U.S. Pat. No. 3,568,426 granted to Whitley on Mar. 9, 1971 discloses still another method and apparatus which produces uniformly spaced regions of entanglements in multi-filament yarns. In this particular apparatus the yarn is fed past a single jet of air.

U.S. Pat. No. 3,340,684 granted to Shichman on Sept. 12, 1967, discloses a device for texturizing yarn which utilizes a difuser.

U.S. Pat. No. 3,346,932 granted to Cheape, Jr. on Oct. 17, 1967 discloses a method for relaxing synthetic fibers wherein heat and streams of gas are utilized for relaxing a bundle of synthetic filaments.

It is to be understood that the above patents are merely examples of such devices presently being utilized and it is to be understood that there are many more patents and apparatus for texturizing and bulking yarns.

SUMMARY OF THE INVENTION

The invention relates to a bulk yarn formed from a plurality of multi-filament yarns which has alternate compact and open segments. The compact segments include first and second plaited portions of multi-filament yarns. The first and second plaited portions are twisted in opposite directions and the open segments of the yarn are defined by loosely bundled multi-filament yarns having a greater cross-section than the compact segment. The plaited portions on opposite sides of the open segments are twisted in opposite directions. Broken filaments are wrapped around the compact segments for aiding in locking the bulked portions in the yarn.

The apparatus for bulking these yarns includes an elongated housing having a longitudinal cylindrical bore extending through the housing. The longitudinal bore has a large diameter portion adjacent an entrance end thereof and a reduced diameter portion at an exit end thereof. A pair of diametrically opposed passages extend through the housing and intersect the larger diameter portion of the longitudinal bore at right angles thereto. A source of pressurized gas, such as air, is connected to a pair of opposed passages for supplying opposed streams of gas into the bore. The multi-filament yarns are fed through the bore between the opposed streams of gas for producing spaced alternate segments of interwoven plaited strands of yarn and loose filament strands of yarn.

A further embodiment of the invention utilizes a housing with a straight bore extending therethrough. Pressurized air is fed through diametrically opposed passages for striking the yarn passing therethrough. Different diameter feed and takeup rolls are used for insuring proper bulking of the yarn.

Accordingly, it is an important object of the present invention to provide a novel bulk yarn.

Another important object of the present invention is to provide an apparatus for imparting bulking to multifilament yarns at a high rate of speed.

Still another important object of the present invention is to provide uniform bulking of yarns as said yarns pass through a tubular housing into which streams of pressurized air engage the yarn for bulking such.

Still another important object of the present invention is to provide a novel method for rapidly imparting bulk portions to multifilament yarns.

Still another important object of the present invention is to provide a bulk yarn which includes alternate sections of large cross-sectional areas and smaller cross-sectional areas that are locked in.

Still another important object of the present invention is to provide a method for bulking yarn utilizing streams of air which minimize the noise produced during the operation.

A further object of the present invention is to provide an apparatus for bulking yarns which is enclosed in a housing for minimizing noise and to which a source of vacuum is connected for removing broken filaments and the like so as not to interfere with the bulking operation.

These and other objects and advantages of the invention will become apparent from reference to the following specification, attendant claims and drawings.

DESCRIPTION OF A PREFERRED EMBODIMENT

Figure 1:
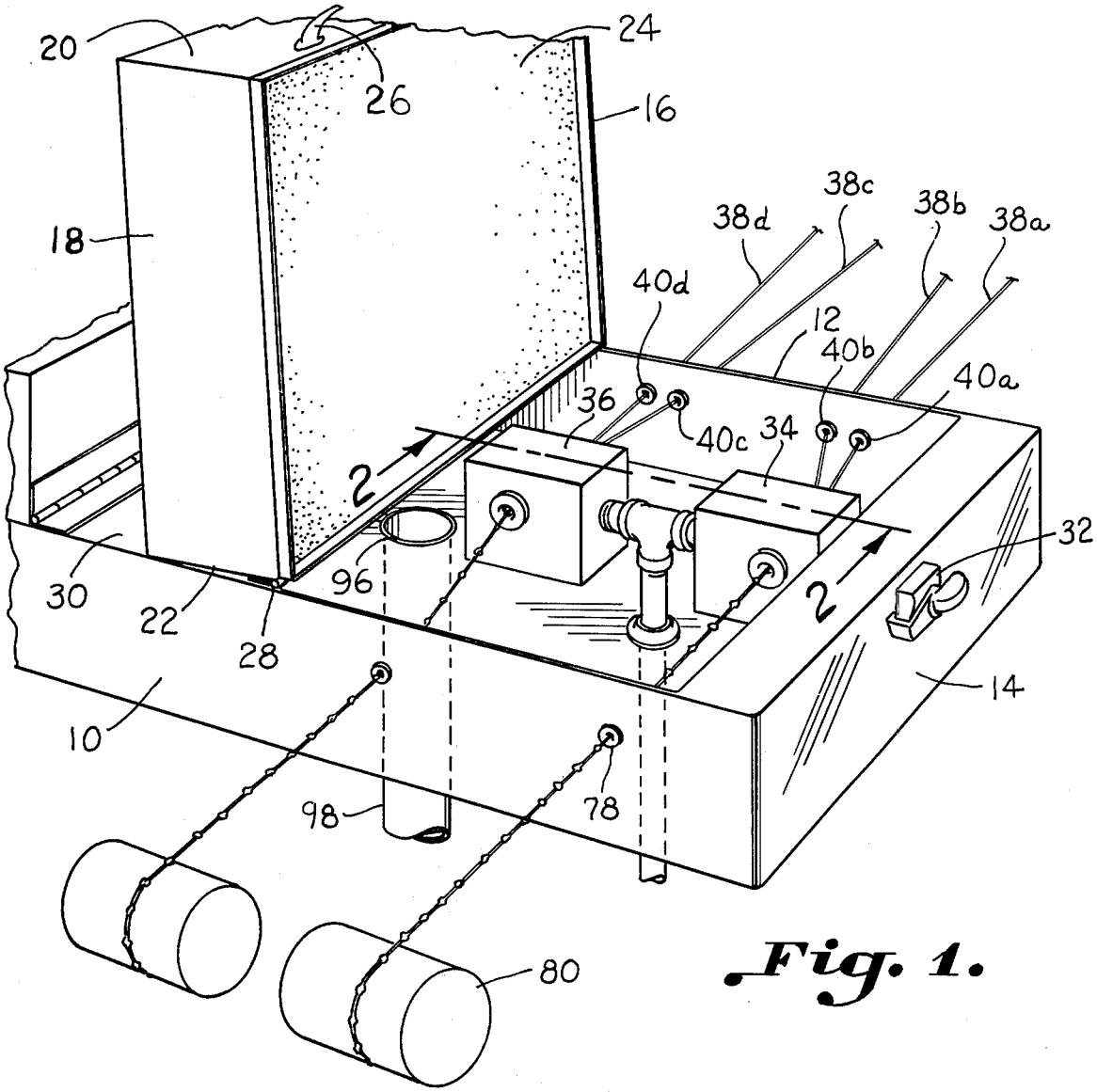
FIG. 1 is a perspective view illustrating an apparatus into which strands of multi-filament yarn are fed for producing a composite bulked yarn.

Referring in more detail to FIG. 1 of the drawings there is illustrated a box defined by opposed side walls 10 and 12 which are joined by an end wall 14. Only one-half of the box is illustrated and the other half, not shown, is constructed in the same manner. A hinged top is provided for the box and has a compartment defined by walls 16 and 18 that are joined by end walls 20 and 22. Carried within a compartment defined by the walls of the top is sponge rubber 24 which absorbs noise. A handle 26 is provided on the front of the top for opening and closing such. As can be seen, the top is connected by a hinge 28 to a top wall 30 of the box. The top can be latched closed on the bottom of the box by means of any suitable latch, such as illustrated at 32 which cooperates with a fastener carried on the top portion (not shown).

Positioned within the right hand end of the box as shown in FIG. 1, there are two elongated housings 34 and 36 through which strands 38*a* through 38*d* pass to be combined to produce a continuous bulk yarn. The strands may be of any type of material, and in one particular instance they are fiberglass and it is 75 denier with 816 filaments within each strand.

The strands 38*a* through 38*d* pass through eyelets 40*a* through 40*d* carried within the side wall 12 and are fed into the housings 34 and 36. Only the operation of one of the housings will be described since both of the housings 34 and 36 are constructed in the identical manner. The housing 34 can be constructed of any suitable material, such as aluminum or stainless steel. The housing has an elongated longitudinal bore 42 extending therethrough. See FIG. 3. Positioned within this elongated bore is a sleeve 44 which has a large diameter bore 48 and a reduced diameter bore 46 therein. At the junction of the large diameter portion 48 and the reduced diameter portion 46 there is a tapered portion 50. A ceramic eyelet 52 is press-fitted within the entrance of the large diameter portion 48 for guiding the strands of multifilament yarn along the longitudinal axis of the bore. Another ceramic eyelet 54 is provided at the exit end of the elongated bore 56.

Figure 2:
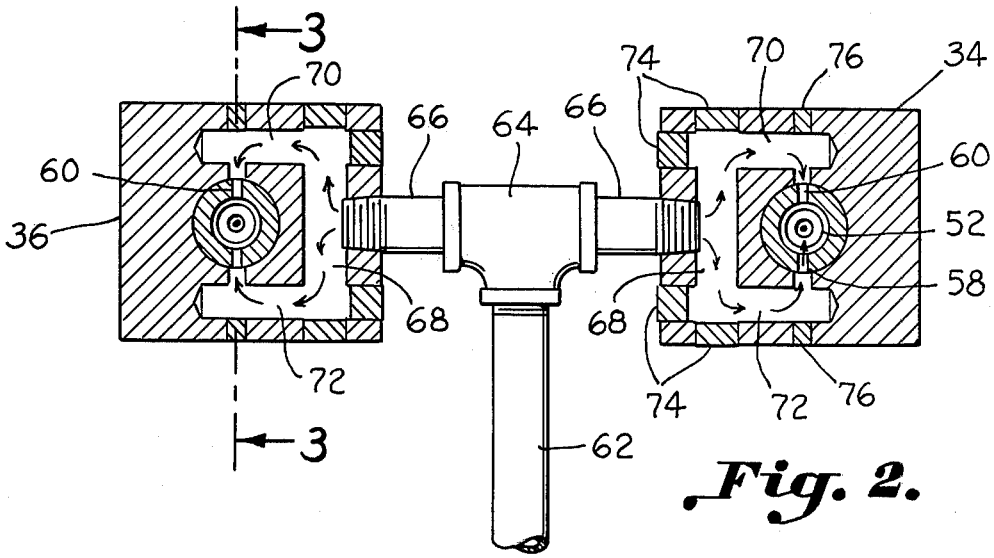
FIG. 2 is a sectional view taken along line 2—2 of FIG. 1.

Diametrically opposed passages 58 and 60 extend through the sleeve 44 for providing air passages. Pressurized air is supplied by an suitable source through a conduit 62 T-joint 64, nipple 66 into a vertical bore 68 provided in the housing through spaced horizontal bores 70 and 72 which communicate with the passages 60 and 58, respectively, to supply streams of pressurized air into the large diameter portion 56 of the longitudinal bore. The passages 58 and 60 are at right angles to said longitudinal axis of said longitudinal bore 56. Therefore, the streams of air are at right angles to the yarn being fed through said bore 56. As can be seen in FIG. 2, the passages 68, 70 and 72 can be drilled into the housing and plugged with plugs 74. Similar plugs 76 are provided for closing the holes in the housing that were produced during drilling of the passages 58 and 60. While the passeges 68 and 60 are shown to include two sections, it is to be understood that such could be a continuous single passageway and the sleeve 44 could be an integral part of the housing 34. One reason for utilizing a sleeve, such as illustrated at 44 instead of drilling out the housing is that the sleeves can be changed for substituting a sleeve having different internal bore dimension. Such is dictated by the number of strands that are being coupled to produce the bulk yarn and the particular yarn being utilized.

After the yarn passes from the exit end of the bore 56 it is then fed through an eyelet 78 provided in the side wall 10 of the box and taken up on any suitable conventional winder as illustrated by the roll 80.

It is to be understood that the bulking apparatus disclosed may be used to bulk single strands of multifilament yarn or a plurality of strands. As shown in FIG. 1, two strands are being combined to produce a single bulk multifilament yarn. Yarn, including four multifilament strands have been combined and it is anticipated that even more could be combined in the manner to be described.

Figure 4:
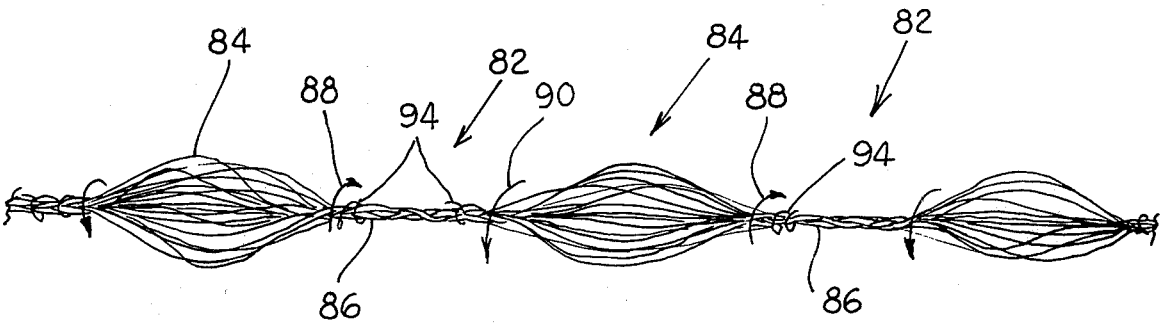
FIG. 4 is an enlarged elevational view illustrating a yarn strand after have been bulked.

The multifilament yarn is taken off of packages and fed through conventional tensioning devices to maintain a uniform tension therein. The strands 38*a* and 38*b* then pass through the eyelets 40*a* and 40*b*, respectively, and are fed through the eyelet 52 which positions the strands along the longitudinal axis of the elongated bore 56. The strand then passes between the opposed stream of pressurized air flowing through the passages 58 and 60 to be engaged by the air. The pressurized air causes alternate sections of compact and loosely held fibers to be produced, such as illustrated in FIG. 4. The compact sections are generally designated by the reference character 82 whereas the loosely held section of filaments are then generally designated by the reference character 84. As can be seen in the enlarged drawing of the yarn in FIG. 4, the loosely bundled section of filaments has a much larger cross-sectional area than the compacted section 82.

The compacted section 82 includes a first portion designated by the reference character 86 that is plaited and twisted in one direction, such as illustrated by the arrow 88. It also includes a second plaited portion 86*a* that is twisted in a direction such as illustrated by the arrow 90. These plaited portions simulate the plait of a child's hair and the exact manner in which such is accomplished by the pair of jet streams is not understood, but it is the inventor's opinion that the strands separate and portions of the strands are pulled therebetween and such is repeated to form a plait. These plaited portions are clearly visible when the bulk yarn is highly magnified.

The segments 84 of the loosely held fibers has very little entanglement, therefore the cross-sectional area or volume is substantially greater. When bulking fiberglass yarn the spacing between the loosely bundled sections 84 are approximately $\frac{5}{8}$ of an inch apart for two strands. When the bulking is applied to a single strand the spacing between the loosely bundled sections 84 is approximately $\frac{3}{4}$ of an inch apart. For example, when bulking a single strand there are approximately seven bulk portions 84 per 6 inches wherein when bulking four strands of fiberglass yarn, there are approximately eight to nine bulk portions 84 per 6 inches.

It is noted that the compacted portions 86 and 86*a* on opposite sides of the bulk portion 84 are twisted in opposite directions.

After the bulk yarn leaves the exit end of the elongated longitudinal bore 56 through eyelet 54, it then passes through an eyelet 78 carried in the side wall 10 of the housing and is wound on a conventional winder illustrated by the spool 80. The tension on the yarn entering the box is normally maintained the same as the tension on the bulk yarn exiting from the box. In one particular apparatus the winding speed, depending on the particular type of multifilament yarn being bulked, can vary from 25 feet per minute to 2,500 feet per minute which is considered to be high speed bulking. Normally, the running speed of fiberglass yarn is 1,000 feet per minute.

During the bulking operation some of the strands of multifilament yarn will break and these strands tend to wrap around the compacted section 82 of the bulk yarn, such as illustrated at 94. These wrapped strands 94 aid in locking in the plaited portions 86 and 86*a*. As a result of the strands being plaited and wrapped with the broken pieces 94 the bulk portions 84 are locked into the strand and when the ends of the strand are pulled such does not pull out. In many of the prior bulk yarns this is not the situation and the bulking of the yarn can be pulled out by pulling the yarn.

A hole 96 is provided in the center of the box to which a hose 98 is connected for coupling such to any suitable source of vacuum. This produces a vacuum within the box and any loose filament or powdery substance created during the bulking operation is removed therefrom so as not to interfere with the bulking of the yarn. It also provides a path for the air going through the conduit 62 into the housing 34 and 36 out of the eyelet 54. This flow of air generates a substantial amount of noise and this noise is reduced substantially by the sound absorbing foam member 24 provided in the top of the cover.

While the internal diameter of the bore 56 can be varied according to the type and number of yarns being bulked, as well as the internal diameter of the air passages 58 and 60, it has been found that air passages 58 and 60 having a diameter between 1/16 and ¼ of an inch are suitable. The internal diameter of the larger portion of the bore can range from 7/16 of an inch to 5/16 of an inch and the internal diameter of the smaller end of the bore is approximately ¼ of an inch. It is to be understood, however, that these dimensions could be varied according to the particular yarn and the number of strands being bulked and such are only dimensions of devices that have been constructed and tested. Other dimension devices may also be suitable.

It has been found that pressurized air from about 25 to 130 pounds per square inch supplied to the air passages 58 and 60 works satisfactorily.

Figure 3:
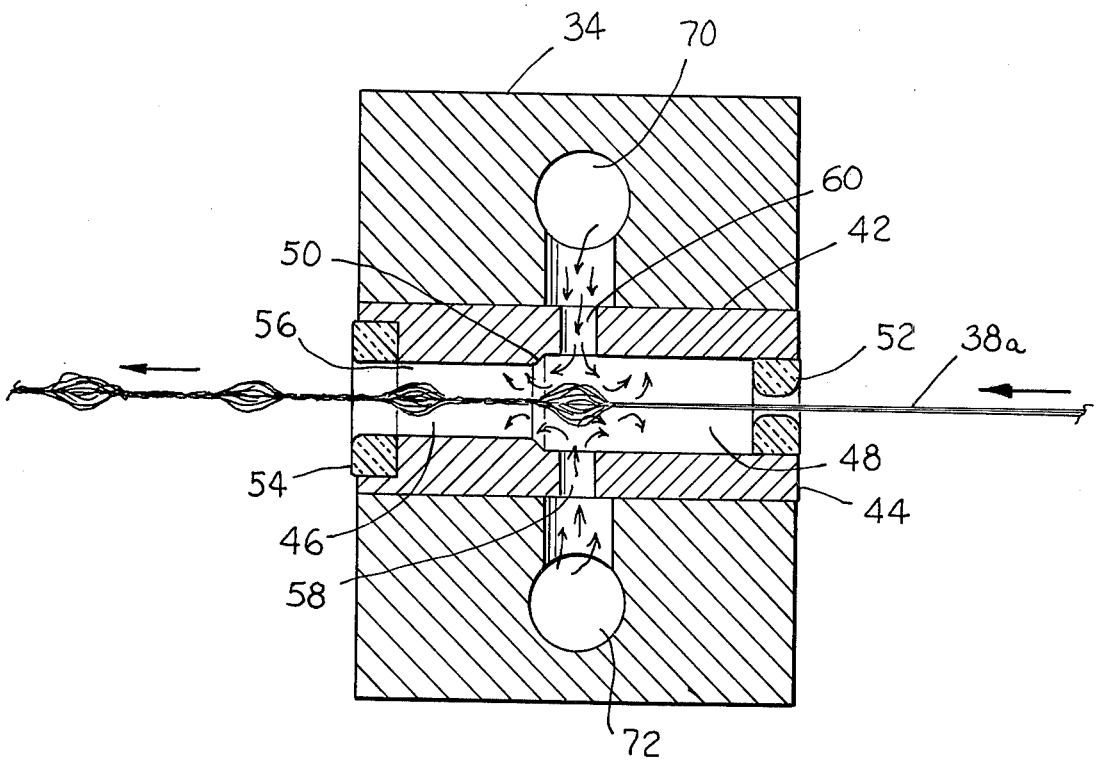
FIG. 3 is a sectional view taken along line 3—3 of FIG. 1.
Figure 5:
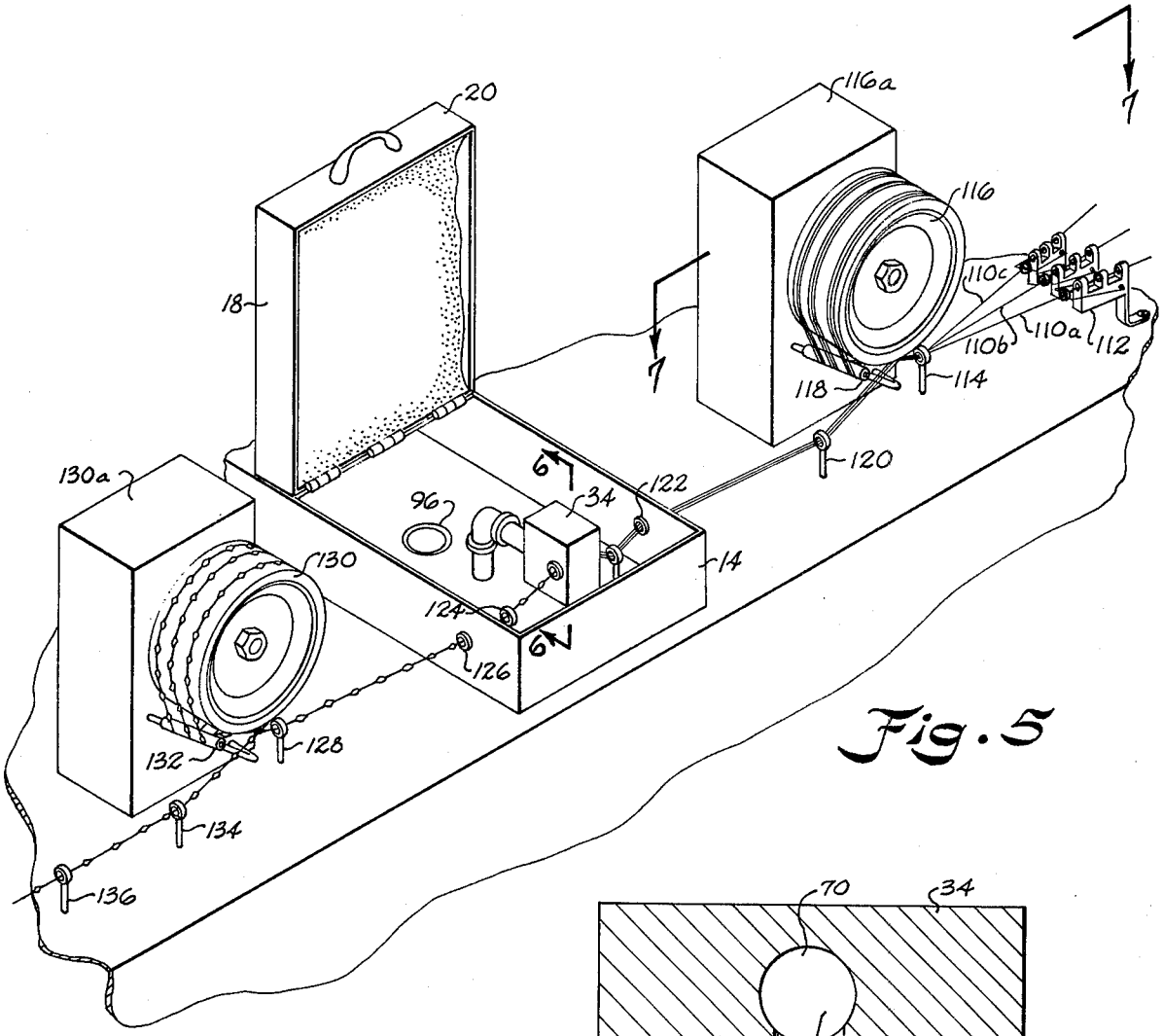
FIG. 5 is a perspective view illustrating a modified form of the invention.
Figure 6:
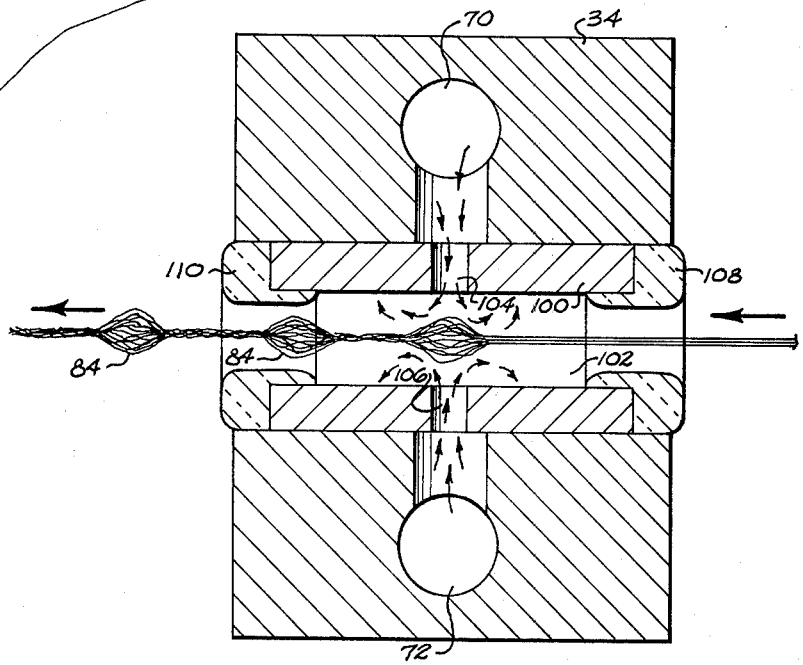
FIG. 6 is a sectional view taken along line 6—6 of FIG. 5.
Figure 7:
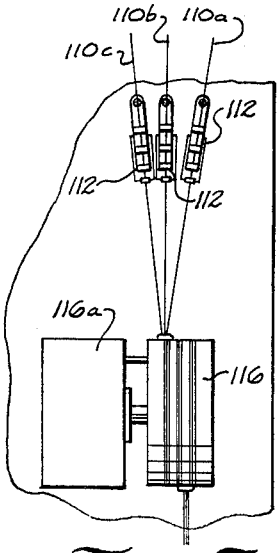
FIG. 7 is a fragmentary plan view taken along line 7—7 of FIG. 5.

FIGS. 5–7 illustrate a modified form of the invention wherein instead of using a sleeve 44 such as illustrated in FIG. 3, which has a stepped diameter bore therein, a sleeve 100 (FIG. 5) is carried within the housing 34 and has a uniform diameter bore 102 extending therethrough. The sleeve 100 has diametrically opposed perpendicular air passages 104 and 106 provided therein which correspond to the air passages of the device shown in FIG. 3. Positioned in the ends of the sleeve are ceramic inserts 108 and 110. The block 34 is constructed in the same manner as that previously described.

Depending on the number of strands being utilized and the denier thereof the diameter of the internal bore 102 can vary. In one particular embodiment, the diameter is ¼ inch and in another particular embodiment the diameter is 7/16 of an inch. For inserts of this type the diameter of the air passages 104 and 106 is 5/32 of an inch.

Strands of multifilament yarns 110*a*, 110*b*, and 110*c* are fed through guides 112 at an angle to an eyelet 114 so that the strands do not lap over each other. The plurality of strands are then wrapped around a driven feed roller 116. The strands also pass around in inclined ceramic rod 118 which prevent the strands from running off of the surface of the roller 116. The strands then leave the roller 116 and pass through another eyelet 120, through an eyelet 122 provided in the side of a box into the housing 34. As the plurality of strands pass through the bore 102 of the sleeve 100 air flowing through the diametrically opposed passages 104 and 106 strike the filaments causing the bulk portions to be produced therein such as illustrated in greater detail in FIG. 4.

After the bulk yarn passes through the housing 34, it is then fed to eyelet 124, eyelet 126 carried in the side wall of the housing and to a spaced eyelet 128. From the spaced eyelet 128 it is wrapped around a takeup roll 130. It is noted that an inclined ceramic member 132 is provided adjacent the surface of the takeup roll 130 for maintaining the wraps of yarn on the surface of the takeup roll 130. As the yarn passes from the takeup roll 130 it is then fed through eyelets 134 and 136 and subsequently wound into a package by a winder.

It is to be understood that the rolls 116 and 130 are driven at the same rpm by motors carried within the respective housings 116*a* and 130*a*. However, the diameter of the input roll 116 is slightly greater than the diameter of the takeup roll 130 so as to enable the bulking action to take place in the housing 34. In one particular embodiment the diameter of the feed roll 116 is 6.104 inches whereas the diameter of the takeup roll 130 is 6.039 inches. Both of the rolls 116 and 130 have a rubberized coating on the surface thereof. One particular roll is manufactured by Dayco Corporation in Greenville, S. C. and the coating is referred to as the Worsted Cots.

From tests performed it has been found that when the diameter of the feed roll 116 is the same as the diameter of the takeup roll 130 bulking is reduced and in order to obtain the same bulking as is produced by the different diameter rolls, it is necessary to increase the air pressure supplied to the air passages 104 and 106 to approximately 150 – 180 pounds per square inch. Normally however, when using the rolls such as for the diameters previously given, the rolls 116 and 130 have air pressure of only 80 to 120 pounds per square inch is required.

While a preferred embodiment of the invention has been described using specific terms, such description is for illustrative purposes only, and it is to be understood that changes and variations may be made without departing from the spirit or scope of the following claims.

What is claimed is:

1. A bulk yarn formed from a plurality of multifilament yarns comprising:

alternating compact and open segments of yarn;

said compact segments including first and second plaited portions of said multifilament yarns;

said first and second plaited portions being twisted in opposite directions, and said open segments of said yarn being defined by loosely bundled multifilament yarns having a greater cross-section than said compact segments.

2. The bulk yarn as set forth in claim 1 wherein said plaited portions on opposite sides of said open segments are twisted in opposite direction.

3. The bulk yarn as set forth in claim 1 further comprising broken filaments wrapped around said compact segments for aiding in locking said plaited portions of said segments together.

* * * * *